US005827902A

United States Patent [19]

Maretto et al.

[11] Patent Number: 5,827,902

[45] Date of Patent: Oct. 27, 1998

[54] FISCHER-TROPSCH PROCESS WITH A MULTISTAGE BUBBLE COLUMN REACTOR

[75] Inventors: Cristina Maretto, Padua; Vincenzo Piccolo, Paullo, both of Italy

[73] Assignees: AGIP Petroli S.p.A., Rome; AGIP S.p.A., Milan, both of Italy; Institut Francais du Petrole, Rueil Malmaison, France

[21] Appl. No.: 907,010

[22] Filed: Aug. 6, 1997

[30] Foreign Application Priority Data

Aug. 7, 1996 [IT] Italy ..... MI96A1717

[51] Int. Cl.[6] ..... C07C 27/00

[52] U.S. Cl. ..... 518/706; 518/700

[58] Field of Search ..... 518/706, 700

[56] References Cited

U.S. PATENT DOCUMENTS 4,312,741 1/1982 Jacquin ..... 518/11

4,624,968 11/1986 Kim et al. ..... 518/707

5,348,982 9/1994 Herbolzheimer et al. ..... 518/700

*Primary Examiner*—Gary Geist

*Assistant Examiner*—J. Parsa

*Attorney, Agent, or Firm*—Oblon, Spivak, McClelland, Maier & Neustadt, P.C.

[57] ABSTRACT

Process for the optimum operation of a slurry bubble column reactor in the presence of a gas phase and a liquid phase, particularly for the Fischer-Tropsch reaction, characterized in that:

1) the process is carried out in a number of stages in series of ≧2;

2) the flow conditions of the gas phase and liquid phase containing the solids are essentially plug flow conditions, with a gas rate of between 3 cm/s and 200 cm/s and a liquid rate of between 0 and 10 cm/s;

3) the concentration of solids in each stage is essentially constant and equal for each single stage, and is between 5 and 50% (vol./vol.).

9 Claims, 7 Drawing Sheets

◇ $u_G^0 = 0{,}10$ m/s
□ $u_G^0 = 0{,}20$ m/s
△ $u_G^0 = 0{,}30$ m/s
X $u_G^0 = 0{,}40$ m/s

FISCHER-TROPSCH PROCESS WITH A MULTISTAGE BUBBLE COLUMN REACTOR

The present invention relates to a process for optimally carrying out a three-phase reaction (solid, liquid and gas), with the use of a bubble column reactor with a number of stages equal to or greater than two.

In the above bubble column reactors, the solid particles are maintained in suspension in the liquid by means of gas bubbles introduced near the lower part of the column.

The process of the present invention can be particularly applied to the process for the production of essentially linear and saturated hydrocarbons, preferably having at least 5 carbon atoms in their molecule, by the reduction of the synthesis gas CO—($CO_2$)—$H_2$, or the mixture of CO and $H_2$, and possibly $CO_2$, according to the Fischer-Tropsch process.

The process of the present invention can be even more particularly applied to exothermic reactions which take place at relatively high temperatures, for example over 100 C.

EP-A-450.860 describes the conditions for optimally carrying out a three-phase reaction, particularly a Fischer-Tropsch reaction, in a bubble column reactor.

The disclosures of EP-A-450.860, based on the hypothesis that there is a single phase, basically relate to the greater convenience of plug flow (PF) conditions with respect to complete mixture flow (CSTR), particularly for high conversions of reagents.

Contemporaneously, by working on the superficial gas velocity, EP'860 tries to avoid impulse flow by means of very large bubbles, with dimensions comparable to those of the reactor (slug flow).

Example 1 of EP'860 shows that PF is better than CSTR, but the comparison is carried out considering a single-phase reactor.

In reality the disclosure of EP'860 is defective in that it does not fully represent the complexity of the three-phase system. In addition EP'860 does not provide the necessary attention to the problem of thermal exchanges, a particularly significant problem in the case of exothermic reactions such as in the case of the Fischer-Tropsch process.

A process has now been found for the optimum operation of a bubble column reactor which overcomes the above inconveniences.

In accordance with this, the present invention relates to a process for the optimum operation of a slurry bubble column reactor in the presence of a gas phase, a liquid phase and a solid phase, particularly for the Fischer-Tropsch reaction which involves the formation of prevalently heavy hydrocarbons starting from gas mixtures comprising CO and $H_2$ in the presence of suitable catalysts, characterized in that:

1) the process is carried out in a number of stages in series of $\geqq 2$, preferably from 2 to 5, even more preferably from 3 to 4, the temperature in each stage being controlled independently;
2) the flow conditions of the gas phase and liquid phase containing the suspended solid are essentially plug flow conditions, with a superficial gas velocity of between 3 cm/s and 200 cm/s, preferably from 5 to 100 cm/s, even more preferably from 10 to 40 cm/s and a superficial liquid velocity of between 0 and 10 cm/s, preferably from 0 to 2 cm/s, even more preferably from 0 to 1 cm/s;
3) the concentration of solid in each step is essentially constant and equal for each single stage, and is between 5 and 50% (vol./vol.), preferably from 10 to 45% v/v, even more preferably from 25 to 40% v/v.

"Independent control of the temperature in each stage" indicates the possibility of obtaining a constant or variable axial temperature profile. In the preferred embodiment the temperature profile is constant in each single stage and equal for all stages.

In the process of the present invention the concentration of solid in each stage is essentially constant and equal for each single stage. The quantity of solid which is transported upwards from the liquid phase and then fed to the subsequent phase is compensated by that coming from the previous stage and by that possibly recycled. One form of embodiment comprises the extraction of the liquid produced plus that which has to be recycled from the stage corresponding to the extreme top of the column; this stream draws the suspended solid which will be separated from the liquid phase (partially or totally) and recycled to the bottom of the column in the form of solid or suspension (concentrated or diluted). The recycled product can also be partitioned and fed to the intermediate stages.

In the preferred embodiment of the present invention, i.e. in the synthesis of hydrocarbons via the reduction of CO, at least part of the solid particles consist of particles of a catalyst selected from those, well known by experts in the field, normally used for catalyzing this reaction. In the process of the present invention any catalyst of the Fischer-Tropsch synthesis can be used, particularly those based on iron or cobalt. Catalysts based on cobalt are preferably used, in which the cobalt is present in a quantity which is sufficient to be catalytically active for the Fischer-Tropsch reaction. The concentrations of cobalt can normally be at least 3% approximately, preferably from 5 to 45% by weight, more preferably from 10 to 30% by weight, with reference to the total weight of the catalyst. The cobalt and possible promoters are dispersed in a carrier, for example silica, alumina or titanium oxide. The catalyst can contain other oxides, for example oxides of alkaline, earth-alkaline, rare-earth metals. The catalyst can also contain another metal which can be active as Fischer-Tropsch catalyst, for example a metal of groups 6 to 8 of the periodic table of elements, such as ruthenium, or it can be a promoter, for example molibden, rhenium, hafnium, zirconium, cerium or uranium. The metal promoter is usually present in a ratio, with respect to the cobalt, of at least 0.05:1, preferably at least 0.1:1, even more preferably from 0.1:1 to 1:1.

The above catalysts are generally in the form of fine powders usually having an average diameter of between 10 and 700 $\mu$m, preferably from 10 to 200 $\mu$m, even more preferably from 20 to 100 $\mu$m. The above catalysts are used in the presence of a liquid phase and a gaseous phase. In the case of Fischer-Tropsch, the liquid phase can consist of any inert liquid, for example of one or more hydrocarbons having at least 5 carbon atoms per molecule. Preferably, the liquid phase essentially consists of saturated paraffins or olefinic polymers having a boiling point higher than 140° C. approximately, preferably higher than about 280° C. In addition appropriate liquid media can consist of paraffins produced by the Fischer-Tropsch reaction in the presence of any catalyst, preferably having a boiling point higher than 350° C. approximately, preferably from 370° C. to 560° C.

The charge of solids, or the volume of catalyst with respect to the volume of suspension or diluent, can reach up to 50%, preferably from 5 to 40%.

In the case of Fischer-Tropsch, the feeding gas comprising carbon monoxide and hydrogen, can be diluted with other, denser gases up to a maximum of 30% in volume, preferably up to 20% in volume, usually selected from nitrogen, methane, carbon dioxide.

The feeding gas is normally introduced into the bottom of the first stage of the reactor and passes through the stages up to the top of the reactor. The use of higher quantities of inert gaseous diluents does not only limit the productivity, but also requires costly separation stages to eliminate the diluent gases.

The conditions, particularly of temperature and pressure, for synthesis processes of hydrocarbons are generally well known. However in the process of the present invention the temperatures can range from 150° C. to 380° C., preferably from 180° C. to 350° C., even more preferably from 190° C. to 300° C. The pressures are generally higher than 0.5 MPa approximately, preferably from 0.5 to 5 MPa, more preferably from 1 to 4 MPa. An increase in temperature, with the other parameters remaining the same, generally causes an increase in productivity; however, in the case of Fischer-Tropsch, the selectivity to methane tends to increase and the stability of the catalyst to decrease with an increase in temperature.

As far as the ratio between hydrogen and carbon monoxide is concerned, this can vary within a wide range.

Although the stoichiometric ratio $H_2$:CO for the Fischer-Tropsch reaction is about 2.1:1, most processes in suspension use relatively low $H_2$:CO ratios. In the process of the present invention the ratio $H_2$:CO is from 1:1 to 3:1, preferably from 1.2:1 to 2.5:1.

BRIEF DESCRIPTION OF THE DRAWINGS

The process of the present invention is illustrated hereafter with reference to FIGS. 1 to 7.

Figure 1:
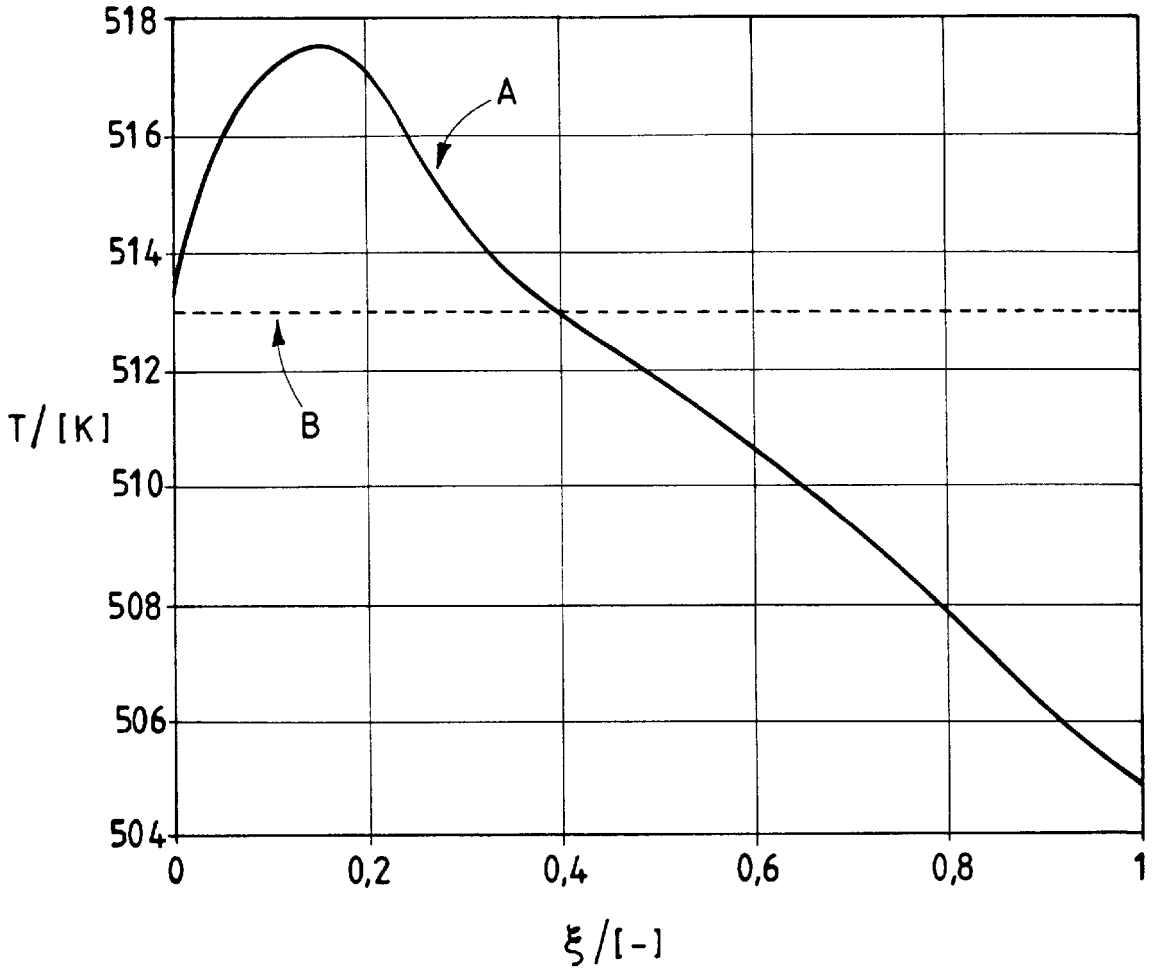
FIG. 1 shows the temperature profile (T in Kelvin degrees) along the axis of the reactor in adimensional co-ordinates ($\xi$) in the column reactor considering plug flow conditions for both the gas and the liquid/solid suspension and with a given specific surface of thermal exchange per unit volume ($a_w$). The operating conditions are: surface velocity of the gas at the inlet of the reactor, $U^i$=0.30 m/s; volumetric fraction of catalyst in the suspension, $\epsilon_s$=0.35; temperature at the inlet of the reactor, $T^i$=513K. In this figure the continuous line represents the temperature profile with $a_w$=30.5 $m^2/m^3$, whereas the dashed line represents the average temperature in the reactor, $T^{avg}$=513K.

As is known to experts in the field, various working regimes of the slurry bubble column can be distinguished depending on the properties of the gas, liquid and solids in question and on the operating conditions such as, temperature, pressure, gas and liquid velocities, flow rates, concentration of the solids, design of the distributor.

At least two working regimes can be identified: homogeneous and heterogeneous. In the former the gas phase flows through the suspension in the form of small finely dispersed bubbles. The latter can be represented by a generalized two-phase model, in which a first phase, called "diluted", consists of the fraction of gas which flows through the reactor in the form of large bubbles. The second ("dense") phase can be represented by the liquid phase in which the particles of solid are suspended and the remaining gas fraction in the form of small finely dispersed bubbles. The large bubbles, having a greater rise velocity than the small ones, can be essentially considered as being in plug flow. The dense phase, consisting of the liquid, the suspended solid and the small finely dispersed bubbles, depending on the operating conditions and geometry of the reactor can be considered as being in plug flow or completely mixed flow.

With reference to the Fischer-Tropsch reaction, example 1 compares the expected conversion level depending on the hypothetical flow conditions for the gas phase and the liquid phase respectively. From the results of example 1, it can be observed that although there is an evident advantage in having plug flow conditions (rather than CSTR) for the gas phase when there is a complete mixture for the liquid phase, there is however as much evident an advantage when also the liquid phase (or suspension) is in plug flow.

Similarly from example 2, referring to heterogeneous conditions, it can be observed that it is again desirable and more convenient to have plug flow conditions not only for the gas phase but also for the liquid phase.

In exothermic processes, like the Fischer-Tropsch process, creating PF conditions for the liquid leads to the disadvantage of having thermal profiles in the column, i.e. temperature profiles axially along the column. In Fischer-Tropsch type processes, the operating temperature control in the reactor is fundamental as it directly influences the selectivity of the reaction; it is also important to prevent the catalyst from undesired over-heating which could be harmful for it.

It is therefore essential to provide the reactor with a suitable cooling system, consisting, for example, of tube-bundles, coils or other types of thermal exchange surfaces immersed in the bulk of the slurry or situated in the internal surface of the reaction column.

Example 3 (FIG. 1) shows, under the same operating conditions and geometry of the reactor, the comparison between the ideal case, assuming isothermal conditions in the column, and the actual case in which there is an axial profile and a maximum temperature can be identified, when plug flow type conditions are adopted both for the gas phase and for the liquid phase, containing the solids.

For each type of catalyst a temperature limit ($T^{lim}$) can be identified above which it is not convenient to operate. This temperature (a function not only of the typical properties of a catalyst, such as activity and selectivity, but also of the refractory properties of the catalyst itself) must not be exceeded during the process.

Figure 2:
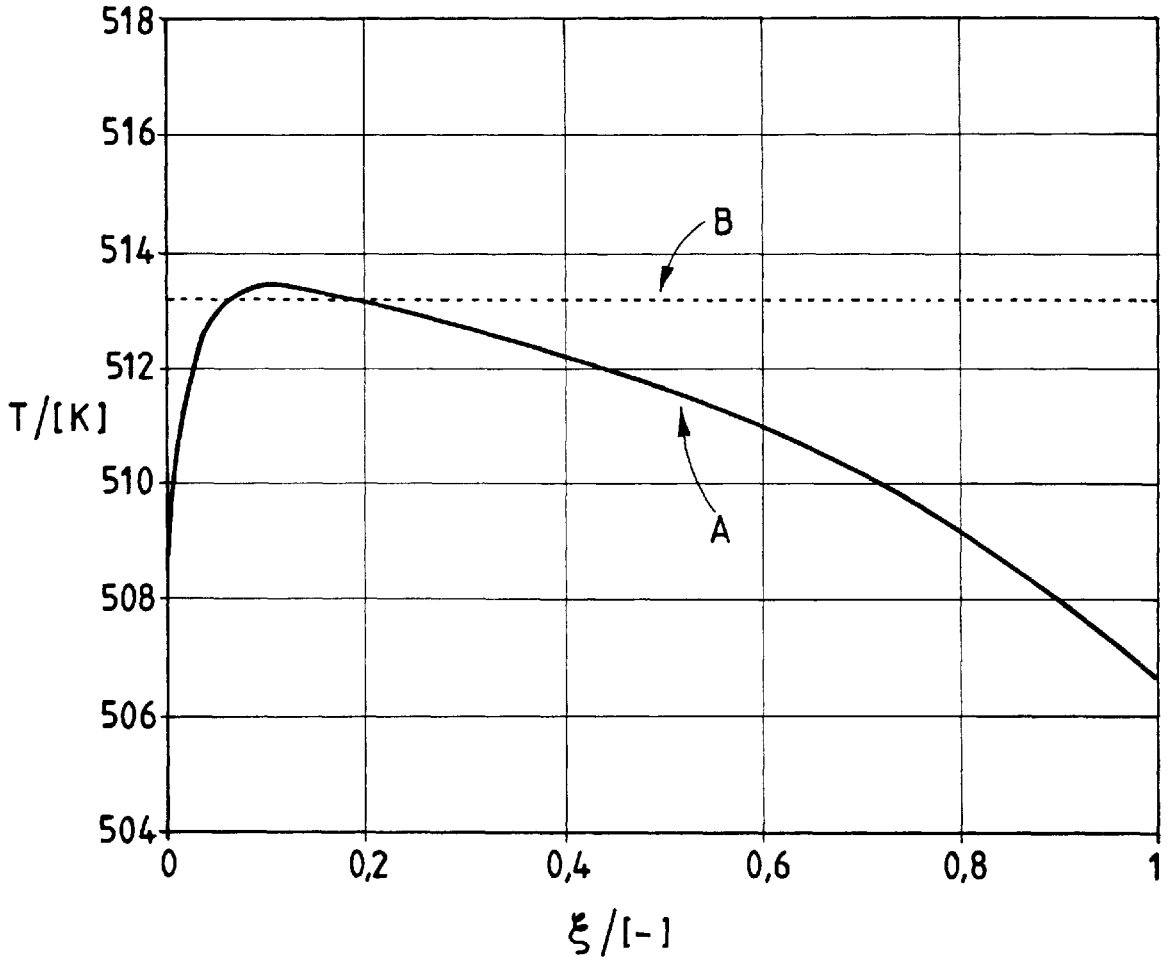
FIG. 2 shows the temperature profile in the column reactor considering plug flow conditions for both the gas and the liquid-solid suspension, comparing the ideal isothermal case and the actual case. The operating conditions are: $U^i$=0.30 m/s; s=0.35; $T^i$=508.2K; maximum limit temperature inside the reactor, $T^{lim}$=513K. The continuous line represents the actual case with $a_w$=32 $m^2/m^3$ whereas the dashed line represents the ideal case.
Figure 3:
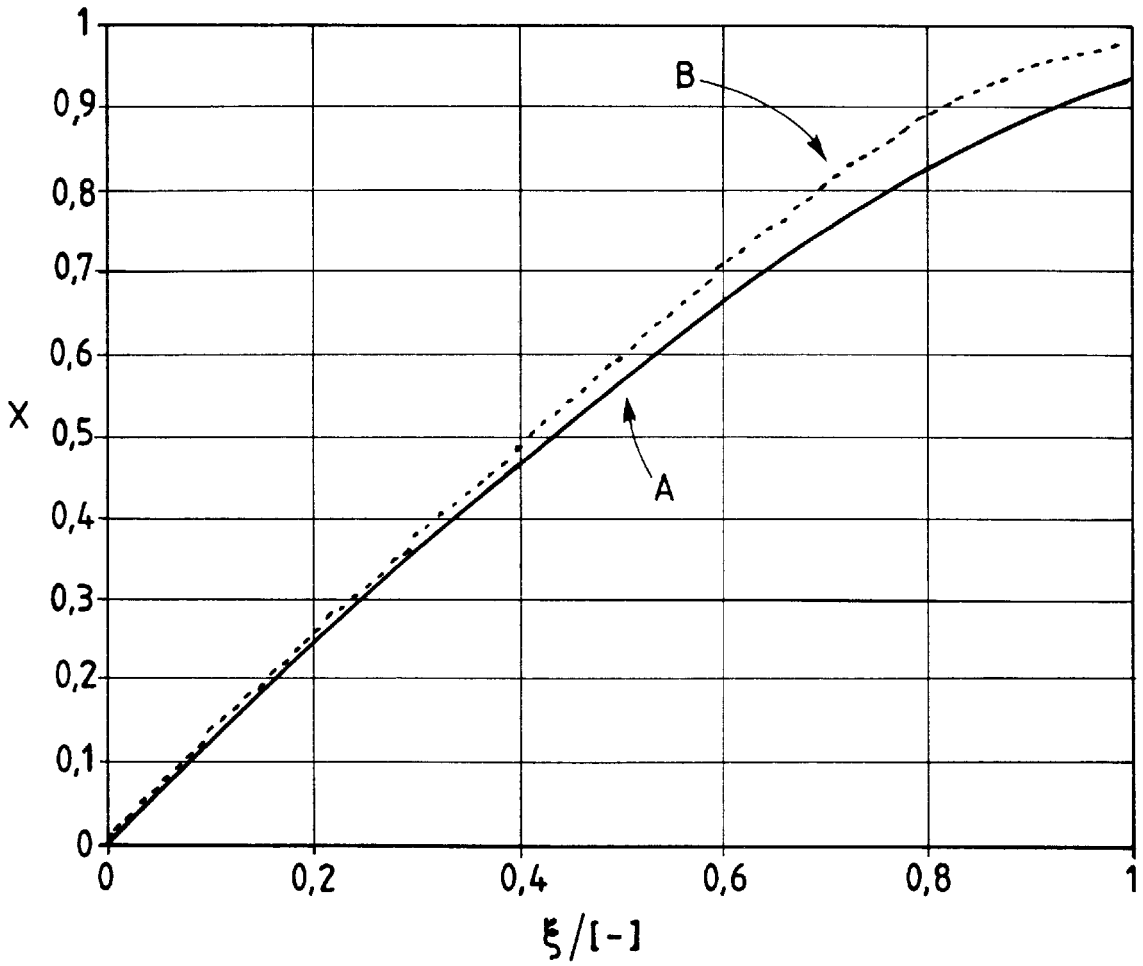
FIG. 3 shows the conversion profile of the syngas in the column reactor considering plug flow conditions for both the gas and the liquid-solid suspension, comparing the ideal isothermal case and the actual case. The operating conditions are: $U^i$=0.30 m/s; $\epsilon_s$=0.35; $T^i$=508.2K; $T^{max}$=513K. The continuous line represents the actual case with $a_w$=32 $m^2/m^3$ whereas the dashed line represents the ideal case.

Example 4 (FIG. 2) shows that by respecting the $T^{lim}$ value, an axial thermal profile should be obtained which is completely below that of the ideal isothermal profile; this implies that the conversion reached with the actual plug flow case (i.e. not isothermal) is lower than the ideal PF case (i.e. isothermal) as indicated in FIG. 3.

Under the typical operating conditions of column reactors, the backmixing of the liquid-solid suspension becomes more and more important as the diameter of the column increases, to the point that it can realistically be claimed that for industrial reactor sizes the liquid phase is completely mixed (when its superficial velocity is limited). On the other hand it is just as legitimate to assume PF for the gas, in processes in which its flow rate is high and its superficial velocity is high.

Consequently from example 5, simulating the slurry column with the CSTR model for the liquid and PF for the gas, it can be observed that the final conversion reached increases with the number of stages, with the same total reaction volume. In other words what could be obtained in several reactors in series, can be obtained in a single multistage reactor.

Figure 4:
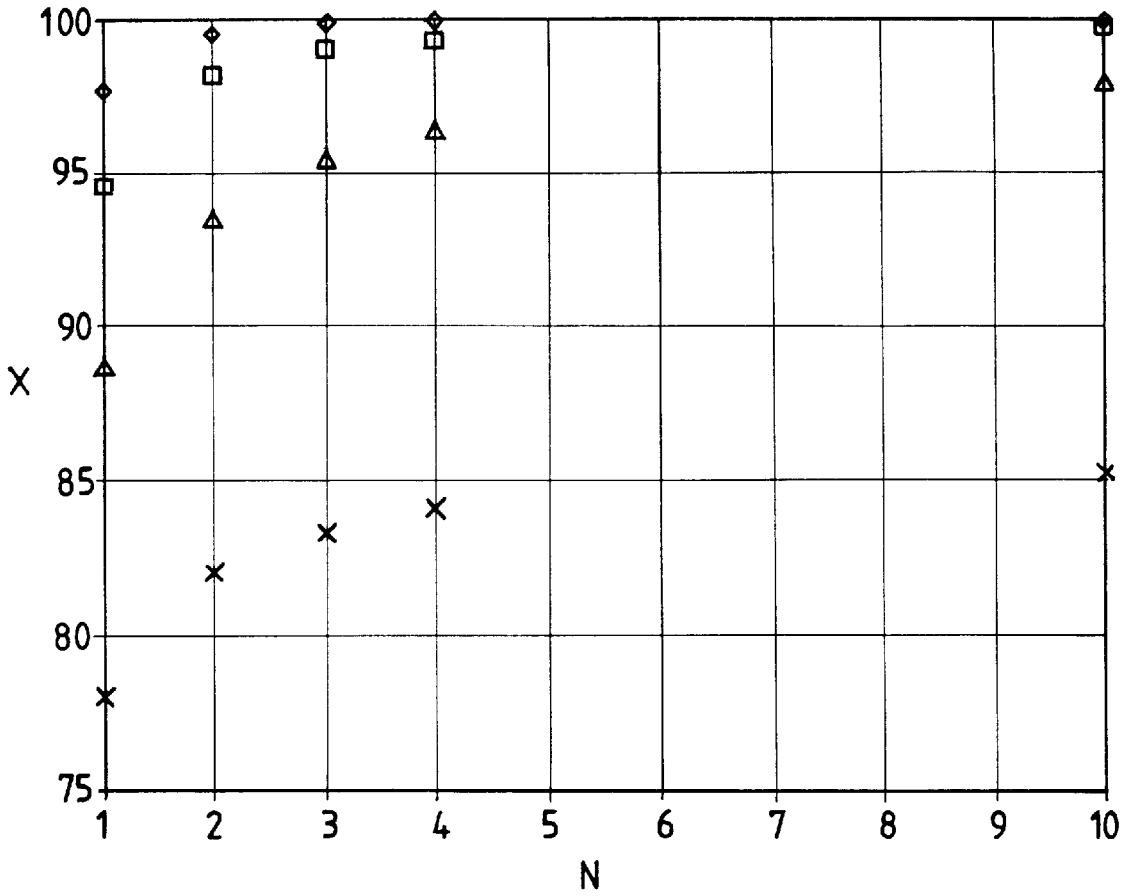
FIG. 4 shows the conversion of the syngas (X) in relation to the superficial velocity of the gas at the inlet of the reactor ($U^i$) and the number of stages (N). For all the tests D=7 m; H=30 m; T=513.2K; P=30 bars; ($H_2$/CO) feed=2.

From FIG. 4 it can be observed that already with 4–5 stages a 90% gain in conversion is obtained. This means that, with the same inlet gas flow rate (or superficial velocity of the gas) and total reaction volume, it is possible to obtain a higher productivity (FIG. 5) by adopting one or more separating means.

Figure 5:
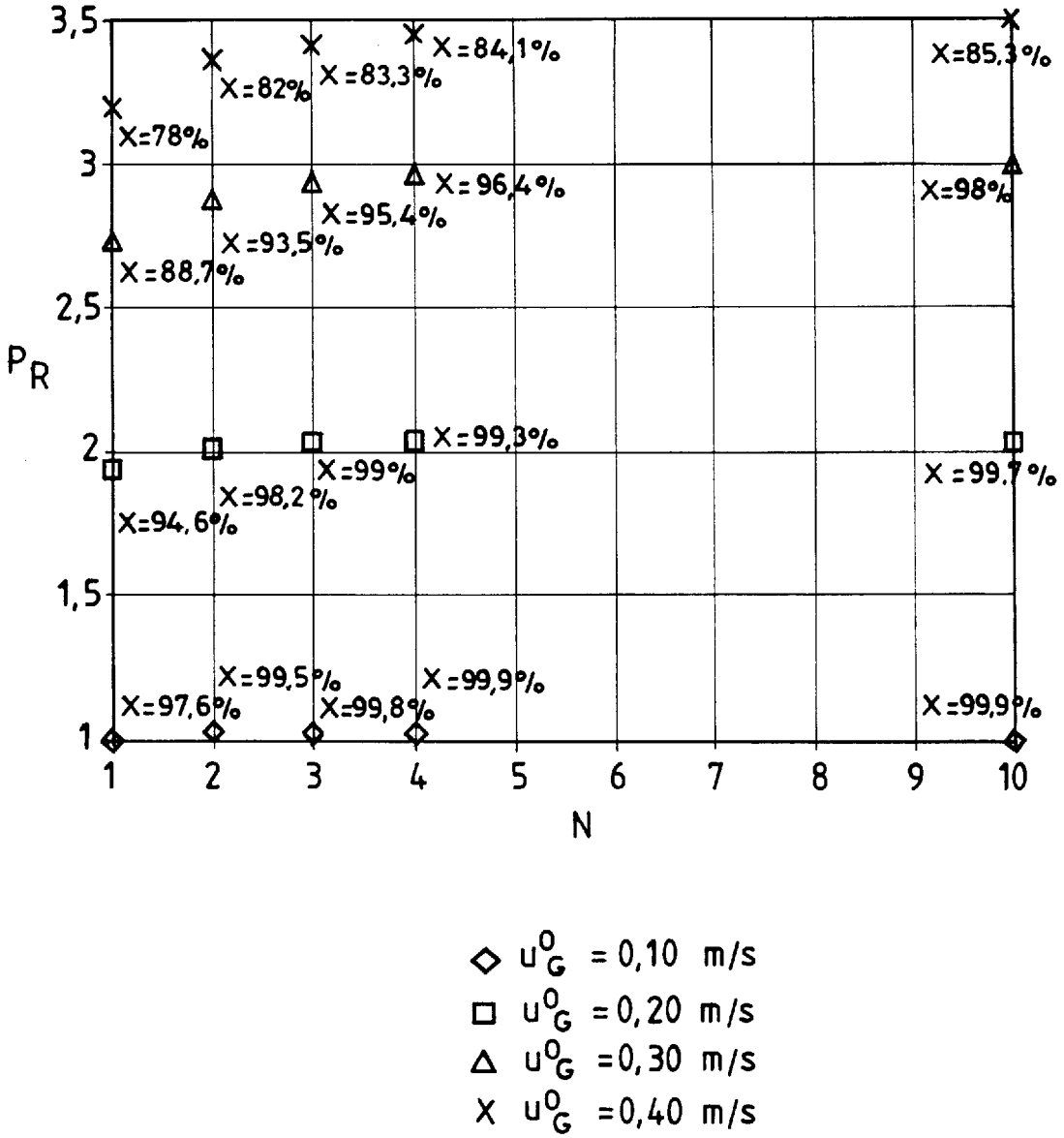
FIG. 5 shows the relative productivity ($P_R$) in relation to the superficial velocity of the gas at the inlet of the reactor ($U^i$) and the number of stages (N). The base case refers to N=1, $U^i$=0.10 m/s. For all the tests D=7 m; H=30 m; T=513.2K; P=30 bars; ($H_2$/CO) feeding=2.

FIG. 5 shows that for a classical "single stage" reactor (N=1), with an increase in the gas flow rate (or superficial velocity of the gas), the conversion in the reactor decreases whereas the productivity increases.

This behaviour can be explained if we consider that the reaction takes place in a completely mixed liquid phase (CSTR). As a result, the reaction rate depends on the final concentration of the reagents in liquid phase, concentration which is higher for smaller conversions of the reagents. In other words, with a higher concentration of the reagents in liquid phase there is a higher reaction rate and therefore a higher productivity. Consequently in the case of the classical reactor (N=1) the increase in productivity is detrimental to the conversion; therefore the higher the productivity required, the higher will be the quantity of non-converted reagents to be recovered and/or recycled.

One of the advantages of the process of the present invention consists in the fact that it allows (owing to a number of stages which is higher than 1) an increase in productivity, also compensating the loss in conversion.

In fact it can be seen from FIG. 5 that, with the same total reaction volume, a conversion of at least 95% is obtained with a single stage when the superficial velocity of the gas is 0.1 m/s, with at least 2 stages when the velocity is 0.2 m/s, with at least 3 stages when it is 0.3 m/s. In this way the productivity is doubled by going from 1 to 2 stages (and from 0.1 to 0.2 m/s) and is almost tripled when going from 1 to 3 stages (and from 0.1 to 0.3 m/s).

It should be pointed out that for each flow rate of gas (or superficial velocity of gas) and total reaction volume, there is a conversion limit increasing the number of stages, which corresponds to that which would be obtained in the case of plug flow of the liquid. In fact it can be observed in FIG. 5 that when N=10 (practically corresponding to a PF of the liquid), the conversion levels reached decrease with an increase in the superficial velocity of the gas.

The hypothesis of isothermicity can be validly accepted owing to the fact that independent cooling systems are adopted for each single stage.

Figure 6:
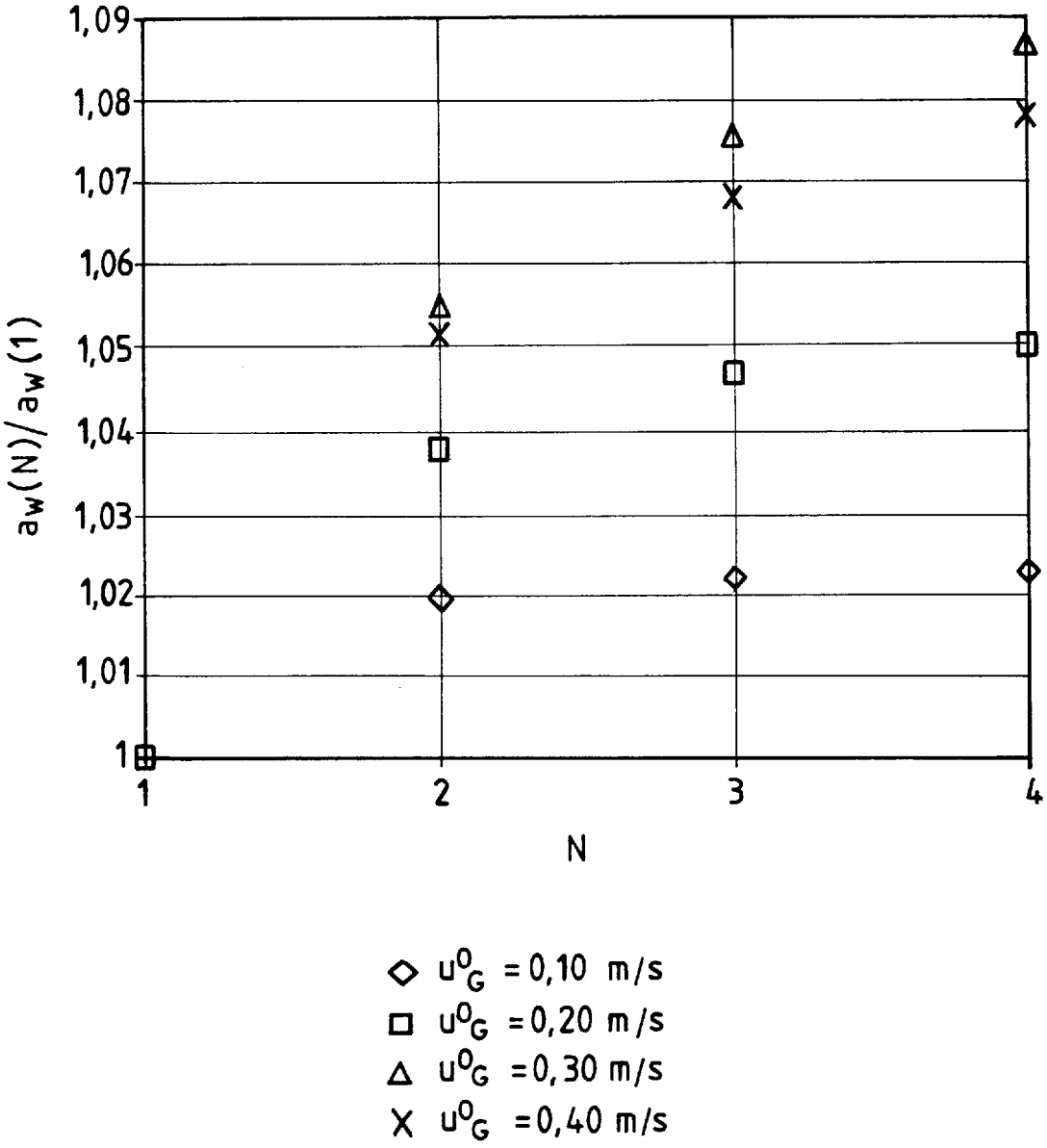
FIG. 6 shows the increase in the specific surface of thermal exchange per unit volume [$a_w$(N)/$a_w$(l)] in relation to the superficial velocity of the gas at the inlet of the reactor ($U^i$) and the number of stages (N). For all the tests D=7 m; H=30 m; T=513.2K; P=30 bars; ($H_2$/CO) feed=2.
Figure 7:
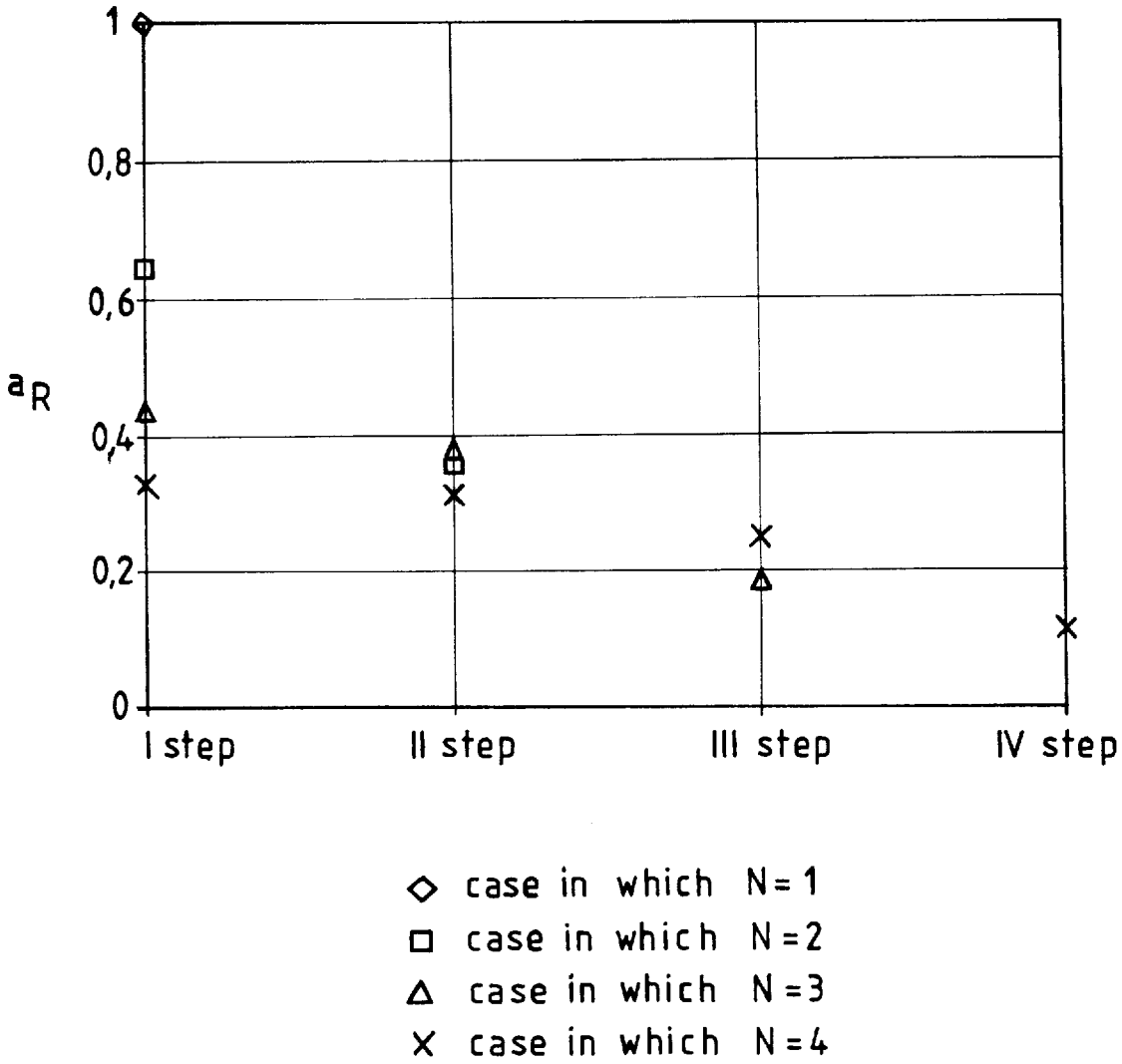
FIG. 7 shows the partition of the specific surface of thermal exchange per unit volume among the various stages ($a_R$) in relation to the number of stages (N). For all the tests D=7 m; H=30 m; T=513.2K; P=30 bars; ($H_2$/CO) feed=2; the figure refers to a superficial velocity of the gas $U^i$ =0.30 m/s.

In example 6, for the same operating conditions applied in example 5, the specific heat exchange surface area was calculated per unit volume. FIG. 6 compares these values in relation to the number N of stages and superficial velocity of the gas. It can be observed that the specific exchange surface area increases with the number of stages N in relation to the increase in conversion induced by the increase itself in the number of stages. To ensure isothermal conditions along the reactor, or in each stage, the heat exchange surface area expected for each stage is proportional to the quantity of heat produced in the same stage. FIG. 7 (example 6) shows how the heat exchange surface area is distributed in each stage as a function of the total number of stages into which the global reaction volume is to be partitioned.

The following examples are provided for a better understanding of the present invention.

EXAMPLE 1

Comparison between different ideal models of three-phase column reactor operating in the homogeneous regime, applied to the case of the Fischer-Tropsch synthesis.

To describe the behaviour of a three-phase column reactor operating in the homogeneous regime at least three ideal models can be identified:

1. a model in which both the gas phase and the liquid phase, containing the suspended solids, can be considered as being completely mixed (CSTR). material balance in the gas-phase:

$$Q_G{}^0 c_{G,i}^0 - Q_G c_{G,i} = (k_L a)_i \left( \frac{c_{G,i}}{H_i} - c_{L,i} \right)$$

material balance in the liquid phase:

$$Q_L{}^0 c_{L,i}^0 - Q_L c_{L,i} = -(k_L a)_i \left( \frac{c_{G,i}}{H_i} - c_{L,i} \right) + \epsilon_L V_L R_i$$

wherein:

$Q_G{}^0$=volumetric flow rate of gas at inlet of the reactor;

$Q_G$=volumetric flow rate of gas at outlet of the reactor;

$Q_L{}^0$=volumetric flow rate of liquid at inlet of the reactor;

$Q_L$=volumetric flow rate of liquid at outlet of the reactor;

$c_{G,i}{}^0$=molar concentration of the reagent i in the gas phase at the inlet of the reactor;

$c_{G,i}$=molar concentration of the reagent i in the gas phase at the outlet of the reactor;

$c_{L,i}{}^0$=molar concentration of the reagent i in the liquid phase at the inlet of the reactor;

$c_{L,i}$=molar concentration of the reagent i in the liquid phase at the outlet of the reactor;

$(k_L a)_i$=gas-liquid volumetric mass transfer coefficient referred to the reagent i;

$H_i$=Henry constant referred to the reagent i;

$\epsilon_L$=hold-up of the suspension (liquid plus solid);

$V_L$=reaction volume;

$R_i$=consumption rate of the reagent i in liquid phase referred to the volume of non-aerated suspension;

i=$H_2$, CO.

As the reaction rate takes place with consumption of the number of moles, to take account of the volumetric contraction of the gas:

$$Q=Q^0(1+\alpha X)$$

is introduced, wherein:

X=conversion of the synthesis gas;

α=contraction factor=1−Q(X=1)/Q(X=0).

2. A model in which it is assumed that only the liquid phase, containing the suspended solid, is completely mixed (CSTR), whereas the gaseous phase flows in the column in plug flow (PF):

material balance in the gas phase:

$$\frac{d(u_G c_{G,i})}{dz} = (k_L a)_i \left( \frac{c_{G,i}}{H_i} - c_{L,i} \right)$$

material balance in the liquid phase:

$$Q_L{}^0 c_{L,i}^0 - Q_L c_{L,i} = -A \int_0^H (k_L a)_i \left( \frac{c_{G,i}}{H_i} - c_{L,i} \right) dz + \epsilon_L V_L R_i$$

wherein:

$u_G$=superficial velocity of the gas;

z=axial coordinate of the reactor;

A=free section of the reactor;

H=height of the aerated suspension (liquid plus solid plus gas).

3. A model in which both the gas phase and the liquid phase, containing the suspended solid, are considered as being in plug flow within the column (PF):

material balance in gas phase:

$$\frac{d(u_G c_{G,i})}{dz} = (k_L a)_i \left( \frac{c_{G,i}}{H_i} - c_{L,i} \right)$$

material balance in liquid phase:

$$-\frac{d(u_L c_{L,i})}{dz} = -(k_L a)_i \left( \frac{c_{G,i}}{H_i} - c_{L,i} \right) + \epsilon_L R_i$$

wherein:

$u_L$=superficial velocity of the liquid phase.

The liquid phase, containing the suspended solids can be under batch conditions or have a cocurrent flow with the gas stream fed to the reactor from the bottom of the column.

The comparison among the different models is made with the same total reaction volume and operating conditions, assuming isothermal conditions. The kinetic refers to a standard catalyst based on Cobalt. The solid is considered as being uniformly distributed in the whole length of the reactor. The calculations are made using three different calculation programs specifically developed to describe the above models applied to the Fischer-Tropsch synthesis reaction. The geometry of the reactor, the operating conditions and results obtained are shown in table 1.

TABLE 1

| | | | |
|---|---|---|---|
| Reactor dimensions | | | |
| Diameter | 7 m | | |
| Height | 30 m | | |
| Operating conditions | | | |
| Temperature | 240° C. | | |
| Pressure | 30 bars | | |
| Composition of inlet gas | $H_2$/CO = 2 (+5% inert products) | | |
| Assumed contraction factor | α = −0.638 | | |
| Inlet gas velocity | 12.5 cm/s | | |
| Inlet liquid velocity | 1.0 cm/s | | |
| Solid concentration (volume fraction) | 0.20 | | |
| Density of suspension (liquid + solid) | 728 kg/m$^3$ | | |
| Results of models: | 1 | 2 | 3 |
| Conversion of the synthesis gas | 74% | 85% | 95% |

Table 1 clearly shows the gain in conversion obtained by shifting from completely mixed conditions for both phases to conditions in which plug flow conditions are assumed, at least for the gas phase. The greatest gain however is obtained when both phases, gas and liquid, containing the suspended solids, are in plug flow conditions. In this case, for isothermal conditions, the conversion reached, under the same conditions, is the maximum one.

EXAMPLE 2

Comparison between different ideal models of three-phase column reactor operating in the heterogeneous regime, applied to the case of Fischer-Tropsch synthesis.

Operating in the heterogeneous regime there is a distinction between the fraction of gas present in the diluted zone and flowing in the column in the form of large bubbles with a plug flow, and the remaining fraction of gas which is entrained in the dense phase in the form of small bubbles, the dense phase consisting of the liquid and dispersed solid. Also in this case, as in the previous example, the results obtained with three different ideal models were compared:

1. A model in which the diluted phase is in plug flow (PF), whereas the dense phase is completely mixed (CSTR), but the contribution of the small bubbles is ignored and it is assumed that the whole flow rate of gas entering the column flows into the reactor in the form of large bubbles:

material balance in gas phase (diluted phase):

$$\frac{d(u_G c_{G,i})}{dz} = (k_L a)_i \left( \frac{c_{G,i}}{H_i} - c_{L,i} \right)$$

material balance in liquid phase (dense phase):

$$Q_L{}^0 c_{L,i}^0 - Q_L c_{L,j} = -A \int_0^H (k_L a)_i \left( \frac{c_{G,i}}{H_i} - c_{L,i} \right) dz + \epsilon_L V_L R_i$$

2. A model in which the diluted phase is in plug flow (PF), whereas the dense phase, including the fraction of small bubbles, is completely mixed (CSTR):

material balance in gas phase (diluted phase):

$$\frac{d((u_G - u_{df}) c_{G,large,i})}{dz} = (k_L a)_{large,i} \left( \frac{c_{G,large,i}}{H_i} - c_{L,i} \right)$$

material balance in gas phase (small bubbles in the dense phase):

$$u_{df} (c_{G,i}^0 - c_{G,small,i}) = (k_L a)_{small,i} \left( \frac{c_{G,small,i}}{H_i} - c_{L,i} \right)$$

material balance in liquid phase (dense phase):

$$Q_L^o c_{L,i}^o - Q_L c_{L,i} = -A\int_0^H (k_L a)_{large,i}\left(\frac{c_{G,large,i}}{H_i} - c_{L,i}\right)dz - A\,(k_L a)_{small,,i}\left(\frac{c_{G,small,i}}{H_i} - c_{L,i}\right) + \epsilon_L V_L R_i$$

wherein the subscripts large and small refer to the gas contained in the large bubbles and the gas contained in the small bubbles, respectively, whereas:

$u_{df}$=superficial velocity of the gas in the dense phase;

$(u_G-u_{df})$=superficial velocity of the gas in the diluted phase.

For all the other symbols the definitions indicated in example 1 are valid.

3. A model in which both the diluted phase and the dense phase are assumed to be in plug flow (PF):

material balance in gas phase (diluted phase):

$$-\frac{d(u_G c_{G,i})}{dz} = (k_L a)_i\left(\frac{c_{G,i}}{H_i} - c_{L,i}\right)$$

material balance in liquid phase (dense phase):

$$-\frac{d(u_L c_{L,i})}{dz} = -(k_L a)_i\left(\frac{c_{G,i}}{H_i} - c_{L,i}\right) + \epsilon_L R_i$$

Also for this example the same assumptions made for example 1 are valid, i.e. the liquid phase containing the suspended solid, can be batch or in a cocurrent flow respect to the gas stream fed to the reactor bottom; the comparison between the different models is carried out adopting the same total reaction volume and operating conditions, assuming isothermal conditions; the kinetics refers to a standard catalyst based on Cobalt; the solid is considered as being uniformly distributed within the whole length of the reactor. The calculations are made using the same calculation programs used in example 1. The geometry of the reactor, the operating conditions and results obtained are shown in Table 2.

TABLE 2

| | | | |
|---|---|---|---|
| Reactor dimensions | | | |
| Diameter | 7 m | | |
| Height | 30 m | | |
| Operating conditions | | | |
| Temperature | 240° C. | | |
| Pressure | 30 bars | | |
| Composition of inlet gas | $H_2/CO$ = 2 (+5% inert products) | | |
| Assumed contraction factor | $\alpha$ = −0.638 | | |
| Inlet gas velocity | 30 cm/s | | |
| Inlet liquid velocity | 1.0 cm/s | | |
| Solid concentration (volume fraction) | 0.35 | | |
| Density of suspension (liquid + solid) | 794 kg/m$^3$ | | |
| Results of models: | 1 | 2 | 3 |
| Conversion of the synthesis gas | 89% | 87% | 98% |

From the results obtained, it can be seen that the introduction of a certain degree of backmixing, due to the effect of the small bubbles entrained in the completely mixed dense phase (model 2), reduces the conversion of the synthesis gas. Also in this case operating with both phases in plug flow guarantees maximum conversion.

EXAMPLE 3

Temperature profile in the three-phase column reactor when in the case of both the gas phase and liquid phase, containing the suspended solid, are considered plug flow conditions and heat exchange is obtained with an internal cooling system. Application to the Fischer-Tropsch synthesis.

The assumption of isothermicity for the three-phase bubble column reactor operating in plug flow conditions for both the gas phase and liquid phase, containing the suspended solid, is not very realistic if extremely exothermic reactions are considered. Even if the heat is removed by an internal cooling system, an axial temperature profile may be established inside the column, whose maximum depends on the conditions of the reaction system and properties of the cooling system. If under the conditions of table 2, instead of assuming isothermal conditions, the heat balance is introduced:

$$c_{p,SL}\rho_{SL}u_L\frac{dT}{dz} = \epsilon_L(-\Delta H)_{CO}R_{CO} - h_W a_W(T - T_W)$$

wherein:

$c_{p,SL}$=specific heat of the suspension (liquid plus solid);

$\rho_{SL}$=density of the suspension (liquid plus solid);

T=temperature inside the reactor;

$T_w$=temperature of the cooling fluid;

$h_w$=overall heat exchange coefficient;

$a_w$=specific exchange surface area per unit volume;

$(-\Delta H)_{CO}$=enthalpy of reaction referred to the reagent CO;

$R_{CO}$=consumption rate of the reagent CO in the liquid phase referred to the volume of non-aerated suspension.

The temperature profile obtained, considering the additional conditions described in table 3, is shown in FIG. 1. In this figure, curve A refers to the temperature profile in the reactor, whereas line B on the other hand corresponds to the average temperature inside the reactor. In the heat balance indicated above the contribution of the gas phase is neglected, whereas it is assumed that the gas, liquid and solid are at the same temperature in each section of the reactor. The additional hypothesis relating to the thermal exchange is that the temperature of the cooling fluid is maintained constant.

TABLE 3

| Additional operating conditions: | |
|---|---|
| Temperature at inlet of the reactor | 240° C. |
| Temperature of the cooling fluid | 230° C. |
| Overall heat exchange coefficient | 0.39 kcal/m$^2$sK |
| Specific exchange surface area per unit volume | 30.5 m$^2$/m$^3$ |
| Heat of reaction referred to the reagent CO | −41.09 kcal/mol. CO |

EXAMPLE 4

Temperature profile in the three-phase column reactor in the case that both the gas phase and the liquid phase, containing the suspended solid, are considered as being in plug flow and heat exchange is obtained with an internal cooling system. A maximum temperature limit, which can be reached inside the reactor, is established. Application to the Fischer-Tropsch synthesis.

For each type of catalyst a temperature limit, $T_{lim}$, can be identified, above which it is not convenient to operate. That means, assuming both the gas and the liquid with the suspended solid in plug flow conditions, it is necessary to control the temperature profile so as not to exceed this limit value in any point of the column. In the case described in example 3, if the value of 240° C. is fixed as $T_{lim}$, to enable this limit to be satisfied it is necessary to improve the thermal exchange, by introducing for example a higher heat exchange surface area. Table 4 indicates the new operating conditions to bring the profile described in FIG. 1 (curve A) below the temperature limit.

TABLE 4

| New operating conditions: | |
|---|---|
| Temperature at inlet of the reactor | 235° C. |
| Temperature of cooling device | 230° C. |
| Overall heat exchange coefficient | 0.39 kcal/m$^2$sK |
| Specific exchange surface area per unit volume | 32 m$^2$/m$^3$ |
| Heat of reaction referred to the reagent CO | −41.09 kcal/mol CO |

With the new parameters deriving from iterative processes with the calculation model, the axial temperature profile which is obtained in the reactor is that described in FIG. 2 (curve A). As in the case of exothermic reactions, and in particular the Fischer-Tropsch synthesis, the kinetics are activated by the temperature. Operating with a temperature profile would mean, under the same conditions, obtaining a lower yield if compared to the case with constant temperature, equal to the maximum limit at which it is possible to operate with a certain catalyst (curve B, FIG. 2). FIG. 3 shows the conversion profiles in the column in the ideal isothermal case (curve B) and in the actual case (curve A) with the temperature profile described in FIG. 2. As can be seen from FIG. 3, the final conversion reached in the column reactor with the ideal hypothesis corresponds to 98%, whereas with the actual hypothesis the conversion of the synthesis gas is reduced to 93%.

EXAMPLE 5

Multistage reactor in which the gas phase is considered as in plug flow in each stage, whereas the liquid phase, containing the solids, is completely mixed in each stage. Application to the Fischer-Tropsch synthesis. I. Conversion of the synthesis gas and productivity of the column reactor against the number of stages.

Adopting model 1 of example 2 to describe the behaviour of each stage, the corresponding calculation program was modified to study the influence of the number of stages into which a certain reaction volume is divided, maintaining isothermal conditions inside each stage and the whole column. The comparison between the performances of the reactor obtained with a varying number of stages was made for different superficial velocities of the gas. In this example it is assumed that the distance between the separating means is constant, i.e. that all the stages have the same height. The operating conditions are described in table 5.

TABLE 5

| Dimensions of the reactor: | |
|---|---|
| Diameter | 7 m |
| Total height | 30 m |
| Number of stages | 1–10 |
| Operating conditions: | |
| Temperature | 240° C. |
| Pressure | 30 bars |
| Composition of gas feed | $H_2$/CO = 2 (+5% inert products) |
| Assumend contraction factor | $\alpha$ = −0.638 |
| Inlet gas velocity | 10–40 cm/s |
| Inlet liquid velocity | 1.0 cm/s |
| Solid concentration (volume fraction) | 0.35 |
| Density of suspension (liquid + solid) | 794 kg/m$^3$ |

FIG. 4 shows the final conversions obtained at the outlet of the entire column for different superficial velocity of the gas in relation to the number of stages into which the column is divided. As can be observed from FIG. 4, by increasing the number of stages, the final conversion level increases, even if over a certain number of stages the conversion tends to reach an asymptote. This asymptote is that corresponding to the assumption of plug flow conditions also for the liquid phase, containing the suspended solid, under isothermal conditions. From FIG. 4 it can also be noted that 90% of the gain in conversion already takes place in the first 4 stages. As a result of the increase in conversion, the productivity of the reactor increases as the number of stages increases, the other conditions remaining the same. FIG. 5 shows the relative productivity values, PR, with a varying number of stages and for different superficial velocity values of the gas at the inlet of the reactor, referring to the base case corresponding to the classical reactor, with a single stage and a gas velocity of 10 cm/s. As can be noted in FIG. 5, which also indicates the respective conversion levels for each relative productivity, the increase in superficial velocity of the gas itself causes a considerable increase in the productivity, to the detriment however of the final conversion level reached in the column. This means that the increase in the gaseous flow rate in the classical reactor (with a single stage), on one hand improves the productivity, but on the other hand implies a greater quantity of non-converted reagents which must be recovered and possibly recycled, causing higher plant and operating costs. The reactor with various stages, on the contrary, allows high productivity values, maintaining high conversion levels of the reagents, in other words improving the performances of the classical reactor with the same operating conditions and geometry of the column.

EXAMPLE 6

Multistage reactor in which the gas phase is considered as in plug flow in each stage, whereas the liquid phase, containing the suspended solid, is completely mixed in each stage. Application to the Fischer-Tropsch synthesis. II. Increase and partition of the heat exchange specific surface area per unit volume.

In example 5, to maintain isothermicity within each stage and in the whole column, all the heat produced by the reaction was removed in each stage. The heat exchange specific surface area per unit volume to be introduced into each stage was calculated, while the heat exchange coefficient and temperature of the cooling fluid remain the same.

With an increase in the number of stages, with the same reaction volume and operating conditions, the total heat exchange surface area increases due to the increase in conversion. FIG. 6 shows the increases in the specific heat exchange surface area, $a_w(N)/a_w(1)$, referred to the case of the classical reactor (single stage), varying the number of stages (from 1 to 4) for different superficial velocity values of the gas. Table 6 shows, in the case relating to 30 cm/s as superficial velocity of the gas, the division of the specific heat exchange surface area per unit volume among the various stages, $a_R$, with a variation in the number of stages. In FIG. 7, on the other hand, the values of table 6 are indicated in the form of a diagram. The same distribution of the heat exchange surface area is qualitatively verified with different gas velocities.

TABLE 6

| Number of stages | $a_R$ | | | |
|---|---|---|---|---|
| | $N_{tot} = 1$ | $N_{tot} = 2$ | $N_{tot} = 3$ | $N_{tot} = 4$ |
| I | 1 | 0.642 | 0.437 | 0.328 |
| II | | 0.358 | 0.378 | 0.31 |
| III | | | 0.185 | 0.249 |
| IV | | | | 0.113 |
| total | 1 | 1 | 1 | 1 |

From the examples described above, it can be seen that operating under such conditions that both the gaseous and liquid phase can be considered as being in plug flow, improves the performance of the reactor, with respect to both conversion and productivity. However, the temperature profiles obtained in the column with a classical, single-stage reactor, if plug flow conditions are verified for both phases, are disadvantageous when operating under a certain temperature limit. With the multistage reactor it is possible:

1) to approach the plug flow behaviour of the gas phase and liquid phase, containing the suspended solid, 2) to maintain the solid uniformly suspended owing to the almost complete mixing conditions for the liquid phase within each stage, 3) to maintain isothermal conditions within each stage and in the whole reaction column.

In this way the performances of the reactor are improved in terms of conversion and productivity.

We claim:

1. A process for the optimum operation of a bubble column reactor in the presence of a gas phase and a liquid phase with suspended solid which involves the formation of prevalently heavy hydrocarbons starting from gaseous mixtures comprising CO and $H_2$ in the presence of suitable catalysts, characterized in that:

1) the process is carried out in a number of stages in series of ≧2, the temperature in each stage being controlled independently;

2) the flow conditions of the gas phase and liquid phase containing the suspended solid are essentially plug flow, with a gas velocity of between 3 cm/s and 200 cm/s and a liquid velocity of between 0 and 10 cm/s;

3) the solid concentration in each stage is essentially constant and equal for each single stage, and is between 5 and 50% (vol./vol.).

2. The process according to claim 1, characterized in that the gas velocity is from 5 to 100 cm/s, the liquid velocity is from 0 to 2 cm/s.

3. The process according to claim 2, characterized in that the gas velocity is from 10 to 40 cm/s, the liquid velocity is from 0 to 1 cm/s.

4. The process according to claim 1, characterized in that the concentration of solid in each stage is from 10 to 45% (v/v).

5. The process according to claim 4, characterized in that the concentration of solid in each stage is from 25 to 40% (v/v).

6. The process according to claim 1, characterized in that the temperature profile is constant in each single stage and equal for all the stages.

7. The process according to claim 1, characterized in that the number of stages is from 2 to 5.

8. The process according to claim 7, wherein the number of stages is from 3 to 4.

9. The process according to claim 1, characterized in that the process comprises a Fischer-Tropsch reaction.

* * * * *